US005879872A

United States Patent [19]

Saeva et al.

[11] Patent Number: 5,879,872

[45] Date of Patent: Mar. 9, 1999

[54] SILVER HALIDE PHOTOGRAPHIC ELEMENTS CONTAINING SULFENIMIDE COMPOUNDS

[75] Inventors: Franklin D. Saeva, Webster; Roger L. Klaus, Rochester; Jerzy Z. Mydlarz, Fairport, all of N.Y.

[73] Assignee: Eastman Kodak Company, Rochester, N.Y.

[21] Appl. No.: 857,397

[22] Filed: May 16, 1997

[51] Int. Cl.[6] ..... G03C 1/00; G03C 1/34

[52] U.S. Cl. ..... 430/569; 430/600; 430/607; 430/611; 430/613; 430/614

[58] Field of Search ..... 430/569, 607, 430/600, 613, 611, 615

[56] References Cited

U.S. PATENT DOCUMENTS

| | | | |
|---|---|---|---|
| 5,217,859 | 6/1993 | Boettcher et al. | 430/569 |
| 5,604,088 | 2/1997 | Asmi et al. | 430/584 |

FOREIGN PATENT DOCUMENTS

| | | |
|---|---|---|
| 0 289 273 | 4/1988 | European Pat. Off. . |
| 1816389 | 7/1970 | Germany . |
| 251 411 | 11/1984 | Germany . |
| 63-163337 | 7/1988 | Japan . |
| 04-157457 | 5/1992 | Japan . |
| 04-186346 | 7/1992 | Japan . |
| 04-194922 | 7/1992 | Japan . |
| 04-350845 | 12/1992 | Japan . |

OTHER PUBLICATIONS

Shibuya et al., Shaskin Gakkaishi (1992), 55 (4), 248–53.

*Primary Examiner*—Thorl Chea
*Attorney, Agent, or Firm*—Sarah Meeks Roberts

[57] ABSTRACT

This invention relates to a silver halide photographic element comprising a silver halide emulsion precipitated and/or chemically sensitized in the presence of an sulfenimide compound represented by the formula:

wherein M represents the atoms necessary to form, with $R^1$ and $R^2$, a five or six-membered ring or a multiple ring system; w is 1 or 0, wherein when w is 0, $R^1$ and $R^2$ are independently substituted or unsubstituted aliphatic, aromatic or heterocyclic groups, and when w is 1, $R^1$ and $R^2$ are independently carbonyl or sulfonyl groups; $R^3$ is independently a substituted or unsubstituted aliphatic, aromatic or heterocyclic group and x is 0 or 1.

19 Claims, No Drawings

SILVER HALIDE PHOTOGRAPHIC ELEMENTS CONTAINING SULFENIMIDE COMPOUNDS

FIELD OF THE INVENTION

This invention relates to the use of certain sulfenimide compounds as antifoggants in silver halide photographic elements and the preparation of silver halide emulsions containing such compounds.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog is usually expressed as "D-min", the density obtained in the unexposed portions of the emulsion. Density, as normally measured, includes both that produced by fog and that produced as a function of exposure to light. It is known in the art that the appearance of photographic fog can occur during many stages of preparation of the photographic element including silver halide emulsion preparation (which includes nucleation, growth, washing, and concentrating the emulsion), spectral/chemical sensitization of the silver halide emulsion, melting and holding of the liquid silver halide emulsion melts, mixing of the emulsion with coating aids and dye-forming couplers, subsequent coating of silver halide emulsions, and prolonged natural and artificial aging and storage of coated silver halide emulsions.

One form of fog, "reduction fog", originates from the reduction of ionic silver to metallic silver. If this metallic silver forms large enough particles associated with the silver halide crystal the particles are spontaneously developable. Intentional reduction sensitization is also sometimes employed to increase the sensitivity of silver halide grains, but if the particle size of the reduced silver is large enough, there is a similar increase in fog. One means of controlling reduction fog is with materials or conditions that oxidize the large metallic silver centers back to silver ions or to a size too small to spontaneously develop.

Several options are available in the art to facilitate the prevention of reduction fog. Thiosulfonic acids and their salts, as discussed in E.Ger. Patent 7376 (1952); F. Mueller, "The Photographic Image, Formation and Structure"; S. Kikuchi, Ed., Focal, London (1970); and U.S. Pat. No. 5,244,781 have been used during emulsion precipitation and sensitization, and during film formation to oxidize reduction fog. Inorganic oxidants such as mercuric salts, peroxides, persulfates, halogens, sulfur, and permanganates have been described in, for example, EP 0 576 920 A2; and U.S. Pat. Nos. 4,681,838 and 2,728,663 as oxidizing reduction fog, as have organic oxidants such as disulfides, halosuccinimides, or quinones in, for example, U.S. Pat. Nos. 5,219,721 and 4,468,454. All of these examples, and others, have their own limitations. Often fog restrainers have a negative impact on sensitometry, particularly speed. Other may react with dye-forming couplers or may be difficult to use. The use of mercuric salts, which have been universally used as fog restrainers because of their effectiveness, versatility and lack of secondary effects, is no longer desirable due to environmental concerns.

Sulfenimide compounds containing an inhibitor fragment which is released during development have been described in JP 04-194922, JP 04-186346, JP 04-157457, JP 04-350845, JP 63-163337, and DD 251 411. The inhibitor fragment is a silver complexing agent and may inhibit fog formation. Development inhibitors, however, can also impact other film parameters such as interimage effects and contrast. Such effects may be unwanted in the photographic element Further, development inhibitors may have deleterious effects on photographic sensitivity if present before or during latent image formation by either disrupting the kinetics of chemical sensitization, by impeding the formation of latent image, or by poisoning the formed latent image.

Consequently, despite the vast amount of effort which has gone into methods to control fog in photographic elements, there is a continuing need in the industry for practical and environmentally benign stabilizers and fog preventers which do not otherwise adversely affect the performance of the photographic element

SUMMARY OF THE INVENTION

This invention provides a silver halide photographic element comprising a silver halide emulsion precipitated and/or chemically sensitized in the presence of a sulfenimide compound represented by the formula:

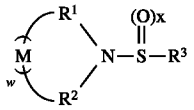

wherein M represents the atoms necessary to form, with $R^1$ and $R^2$, a five or six-membered ring or a multiple ring system; w is 1 or 0, wherein when w is 0, $R^1$ and $R^2$ are independently substituted or unsubstituted aliphatic, aromatic or heterocyclic groups, and when w is 1, $R^1$ and $R^2$ are independently carbonyl or sulfonyl groups; $R^3$ is independently a substituted or unsubstituted aliphatic, aromatic or heterocyclic group and x is 0 or 1. In one embodiment the sulfenimide compound has been added at the start of or during precipitation of the silver halide emulsion.

The invention further provides a method of making a silver halide emulsion comprising precipitating and chemically sensitizing the emulsion and further comprising adding to the emulsion at any time before or during chemical sensitization a sulfenimide compound represented by above formula.

The silver halide photographic elements of this invention exhibit reduced fog without a large loss of photographic speed. The sulfenimide compounds used in this invention can be used to replace mercuric salts and are themselves environmentally benign.

DETAILED DESCRIPTION OF THE INVENTION

The inventors herein have discovered that certain sulfenimide compounds are particularly useful as fog restrainers for silver halide elements. The inventive compounds herein do not utilize inhibitor fragments which are released during development by reaction with oxidized developer. The sulfenimide compounds utilized in this invention are represented by the following formula:

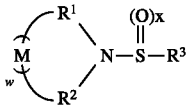

M represents the atoms necessary to form, with $R^1$ and $R^2$, a five or six-membered ring or a multiple ring system. These ring systems may be substituted or unsubstituted. The ring and multiple ring systems may be alicyclic or they may be the aromatic and heterocyclic groups described below. w is 1 or 0.

When w is 0, $R^1$ and $R^2$ can be any substituents which are suitable for use in a silver halide photographic element and which do not interfere with the fog restraining activity of the sulfenimide compound. Preferably $R^1$ and $R^2$ are independently substituted or unsubstituted aliphatic, aromatic or heterocyclic groups.

When w is 1, $R^1$ and $R^2$ are independently carbonyl or sulfonyl groups, and more preferably carbonyl groups. Preferably M represents the atoms necessary to form, with $R^1$ and $R^2$, a substituted or unsubstituted aryl group having 6 to 10 carbon atoms or a substituted or unsubstituted 5 to 10-membered heterocyclic ring. Most preferably M represents the atoms necessary to form, with $R^1$ and $R^2$; a phthalimide or succinimide group.

$R^3$ is any substituent which is suitable for use in a silver halide photographic element and which does not interfere with the fog restraining activity of the sulfenimide compound. Preferably $R^3$ is independently a substituted or unsubstituted aliphatic, aromatic or heterocyclic group. x is 0 or 1.

When $R^1$, $R^2$ and $R^3$ are aliphatic groups, preferably, they are alkyl groups having from 1 to 20 carbon atoms, or alkenyl or alkynyl groups having from 2 to 20 carbon atoms. More preferably, they are alkyl groups having 1 to 6 carbon atoms, or alkenyl or alkynyl groups having 3 to 5 carbon atoms. Most preferably they are alkyl groups having 1 to 5 carbon atoms. These groups may or may not have substituents. Examples of alkyl groups include methyl, ethyl, propyl, butyl, pentyl, hexyl, octyl, 2-ethylhexyl, decyl, dodecyl, hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings or condensed rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

$R^3$ is preferably a substituted or unsubstituted alkyl group having 1 to 6 carbon atoms, a substituted or unsubstituted aryl group having 6 to 10 carbon atoms or a substituted or unsubstituted 5 to 6-membered heterocyclic ring. In one preferred embodiment, when w is 0, $R^1$ and $R^2$ are also independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

Nonlimiting examples of substituent groups for $R^1$, $R^2$ and $R^3$ and M include alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl). Preferred substituents are lower alkyl groups, i.e., those having 1 to 4 carbon atoms (for example, methyl) and halogen groups (for example, chloro).

Specific examples of the sulfenimide compounds include, but are not limited to

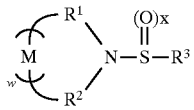

General Structure

| $R^1$ | $R^2$ | M | W | $R^3$ | x | Compound | |
|---|---|---|---|---|---|---|---|
| O | O | 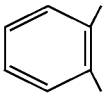 | 1 | 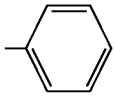 | 0 | 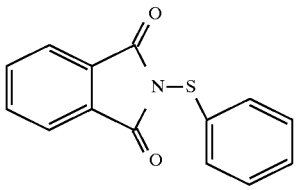 | 1 |
| O | O | 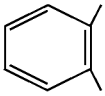 | 1 | 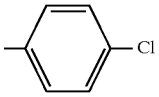 | 0 | 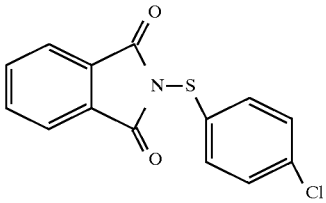 | 2 |

-continued
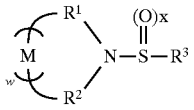
General Structure
| $R^1$ | $R^2$ | M | W | $R^3$ | x | Compound | |
|---|---|---|---|---|---|---|---|
| O | O | 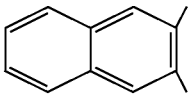 | 1 | 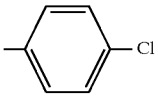 | 0 | 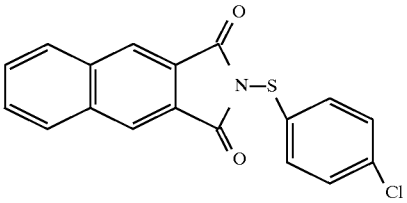 | 3 |
| O | O | 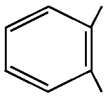 | 1 | 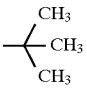 | 0 | 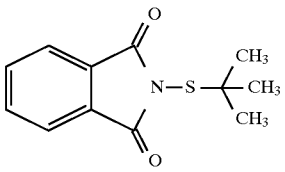 | 4 |
| O | O | 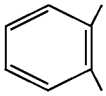 | 1 | 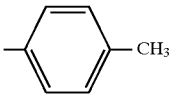 | 0 | 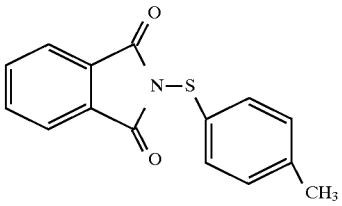 | 5 |
| O | O | 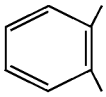 | 1 | 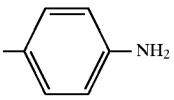 | 0 | 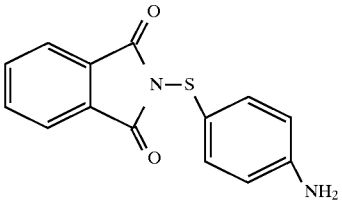 | 6 |
| O | O | 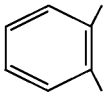 | 1 | 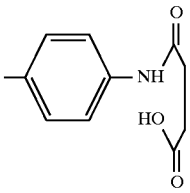 | 0 | 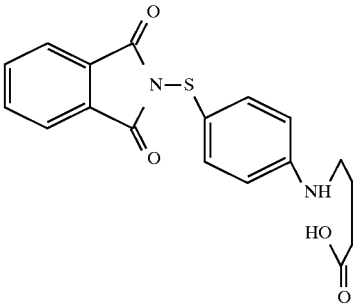 | 7 |
| O | O | 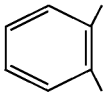 | 1 | 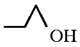 | 0 | 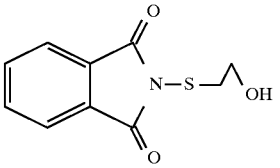 | 8 |

-continued
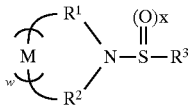
General Structure
| $R^1$ | $R^2$ | M | W | $R^3$ | x | Compound | |
|---|---|---|---|---|---|---|---|
| O | O | | 1 | | 1 | | 9 |
| O | O | | 1 | | 1 | | 10 |
| O | O | | 1 | | 1 | | 11 |
| O | O | | 1 | | 1 | | 12 |
| O | O | | 1 | | 1 | | 13 |
| O | O | | 1 | | 1 | | 14 |
| O | O | | 1 | $Na^+$ | 1 | $Na^+$ | 15 |

-continued
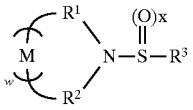
General Structure
| $R^1$ | $R^2$ | M | W | $R^3$ | x | Compound | |
|---|---|---|---|---|---|---|---|
| 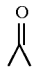 | 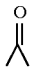 | 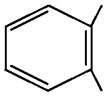 | 1 | 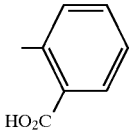 | 1 | 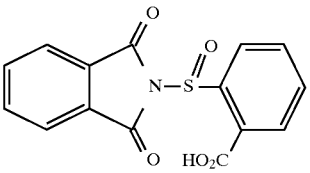 | 16 |
| 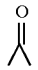 | 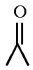 | 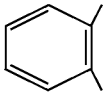 | 1 | 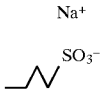 | 1 | 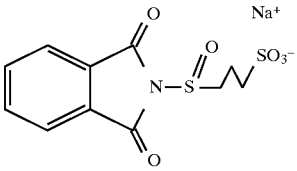 | 17 |
| 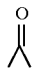 | 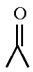 | 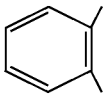 | 1 | 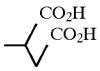 | 0 | 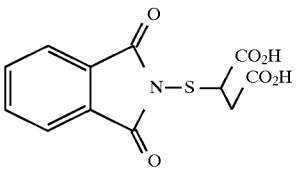 | 18 |
| 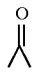 | 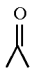 | 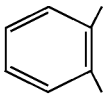 | 1 | 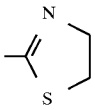 | 1 | 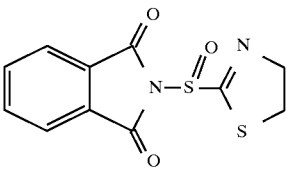 | 19 |
| 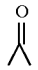 | 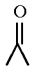 | 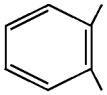 | 1 | 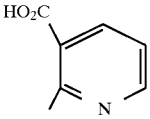 | 1 | 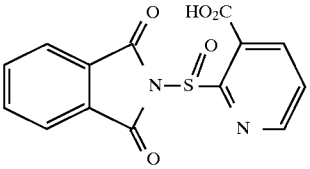 | 20 |
| 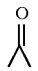 | 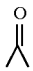 | 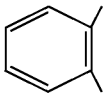 | 1 | 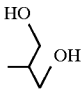 | 0 | 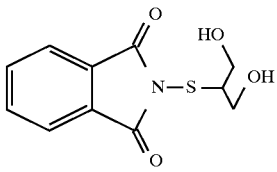 | 21 |
| 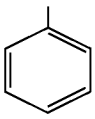 | 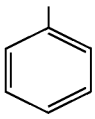 | | 0 | 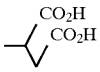 | 0 | 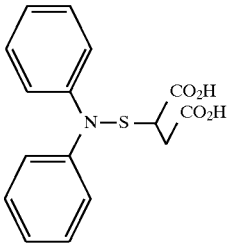 | 22 |

-continued
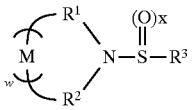
General Structure
| $R^1$ | $R^2$ | M | W | $R^3$ | x | Compound | |
|---|---|---|---|---|---|---|---|
| 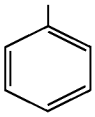 | 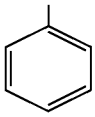 | | 0 | 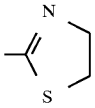 | 1 | 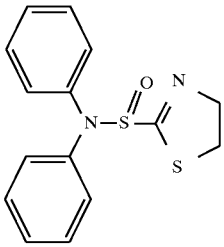 | 23 |
| 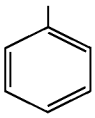 | 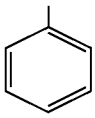 | | 0 | 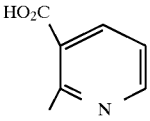 | 1 | 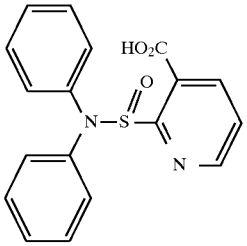 | 24 |
| 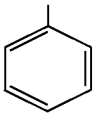 | $CH_3$ | — | 0 | 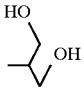 | 1 | 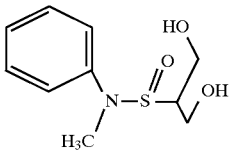 | 25 |
| 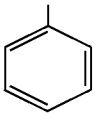 | $CH_3$ | — | 0 | 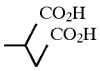 | 1 | 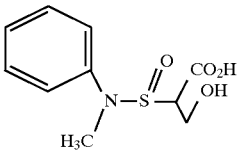 | 26 |
| 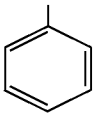 | $CH_3$ | — | 0 | 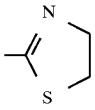 | 1 | 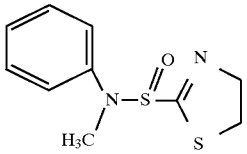 | 27 |
| 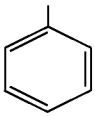 | $CH_3$ | — | 0 | 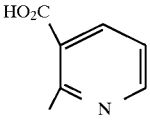 | 1 | 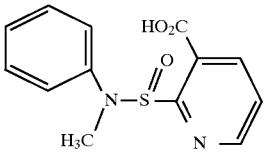 | 28 |
| — | — | $CH_2$ | 4 | 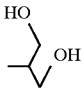 | 0 | 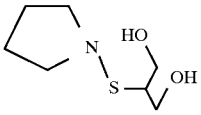 | 29 |
| — | — | $CH_2$ | 4 | 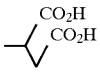 | 0 | 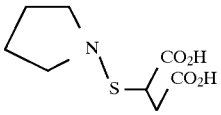 | 30 |

-continued
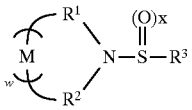
General Structure
| $R^1$ | $R^2$ | M | W | $R^3$ | x | Compound | |
|---|---|---|---|---|---|---|---|
| — | — | $CH_2$ | 4 | 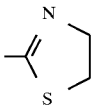 | 1 | 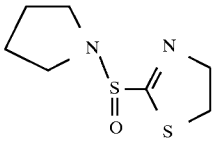 | 31 |
| — | — | $CH_2$ | 4 | 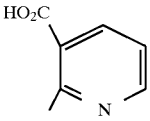 | 1 | 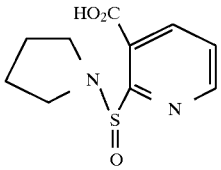 | 32 |
| 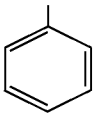 | $CH_3$ | — | 0 | 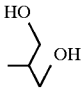 | 0 | 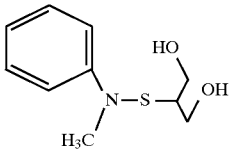 | 33 |
| 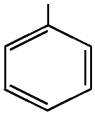 | $CH_3$ | — | 0 | 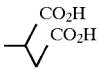 | 0 | 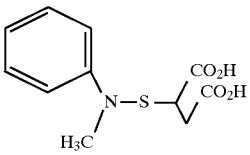 | 34 |
| 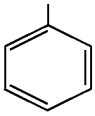 | $CH_3$ | — | 0 | 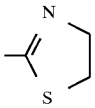 | 1 | 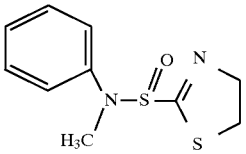 | 35 |
| 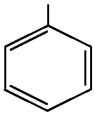 | $CH_3$ | — | 0 | 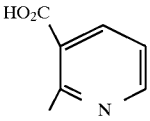 | 1 | 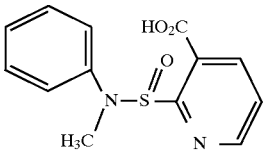 | 36 |
| $SO_2$ | $SO_2$ | 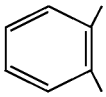 | 1 | 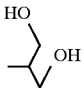 | 0 | 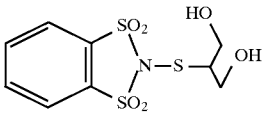 | 37 |
| $SO_2$ | O | 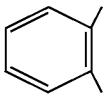 | 1 | 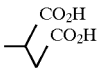 | 0 | 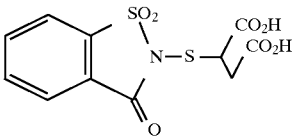 | 38 |
| $SO_2$ | O | 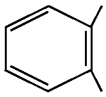 | 1 | 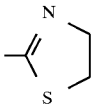 | 1 | 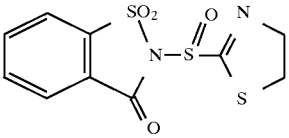 | 39 |

-continued
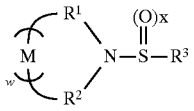
General Structure
| $R^1$ | $R^2$ | M | W | $R^3$ | x | Compound | |
|---|---|---|---|---|---|---|---|
| $SO_2$ | O | | 1 | | 1 | | 40 |
| O | O | | 1 | | 0 | | 41 |
| O | O | | 1 | | 0 | | 42 |
| O | O | | 1 | | 1 | | 43 |
| O | O | | 1 | | 0 | | 44 |
| $SO_2$ | O | | 1 | | 1 | | 45 |
| $SO_2$ | O | | 1 | | 1 | | 46 |
| $SO_2$ | O | | 1 | | 1 | | 47 |

-continued

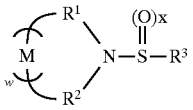

General Structure

| $R^1$ | $R^2$ | M | W | $R^3$ | x | Compound | |
|---|---|---|---|---|---|---|---|
| $SO_2$ | O | | 1 | Cl | 0 | | 48 |
| O | O | | 1 | $CH_3$ | 1 | | 49 |
| O | O | | 1 | $NH_2$ | 1 | | 50 |
| O | O | | 1 | NH HO O | 1 | | 51 |
| O | O | | 1 | OH | 1 | | 52 |
| O | O | | 1 | H | 1 | | 53 |

Compounds 1 and 2 are examples of particularly suitable compounds for use in this invention.

The sulfenimide compounds are readily synthesized by the reaction of sulfenyl chlorides with the corresponding phthalimide anion. In one embodiment, the sulfenyl chlorides may be synthesized by the reaction of excess chlorine gas with a thiol, such as thiophenol, in carbon tetrachloride solvent. The reaction should be monitored, for example by infrared spectroscopy, to determine that the reaction is complete. The carbon tetrachloride solvent is flash evaporated and the sulfenyl chloride is dissolved in a suitable solvent such as chloroform. The appropriate phthalimide, such as potassium phthalimide (commercially available from Aldrich Chemical Co.) is added to the sulfeny chloride ( one equivalent of phthalimide) at room temperature. The reaction is allowed to stir at room temperature for four hours and the extent of the reaction is determined, for example by thin layer chromatography. The reactions are normally complete after a few hours. The chloroform solvent is flash evaporated and the sulfenimide product is recrystallized from ethanol.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), alkoxy groups, hydroxy groups, alkylthio groups, arylthio groups, acylamino groups, sulfonylamino groups, acyloxy groups, carboxyl groups, cyano groups, sulfo groups and amino groups.

Useful levels of the sulfenimide compounds range from about $1\times10^{-9}$ to $1\times10^{-2}$ mol/mol Ag. The amount to be added is somewhat dependent on the point of addition. If the compound is added after precipitation preferred levels range from about $1\times10^{-6}$ to $1\times10^{-2}$ mol/mol Ag. If the sulfenimide compound is added at the start of or during precipitation the preferred range is from about $1\times10^{-9}$ to $1\times10^{-3}$ mol/mol Ag.

The sulfenimide compounds may be added to the photographic emulsion using any technique suitable for this purpose. They may be dissolved in most common organic solvents, for example, methanol or acetone. The compounds can be added to the emulsion in the form of a liquid/liquid dispersion similar to the technique used with certain couplers. They can also be added as a solid particle dispersion.

The sulfenimide compounds may be used in addition to any conventional emulsion stabilizer or antifoggant as commonly practiced in the art. Combinations of more than one sulfenimide compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The sulfenimide compounds may be added to the silver halide emulsion at any time before or during precipitation and/or chemical sensitization. They may be added before or during precipitation in an amount which will wash out before the heat treatment of chemical sensitization, or they may be added before or during precipitation in an amount which will result in some of the sulfenimide compound being present during the heat treatment which completes chemical sensitization so that the emulsion is chemically sensitized in the presence of the compound. They may also be added at any time after precipitation and before or during the heat treatment employed to complete chemical sensitization so that the emulsion is chemically sensitized in the presence of the compound. They may also be added both before or during precipitation and before or during chemical sensitization so that the beneficial aspects of the compounds are available at all stages of precipitation and chemical sensitization. More preferably the compounds are added at the start of or during precipitation of the emulsion.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The sulfenimide compounds are useful with intentionally or unintentionally reduction sensitized emulsions. As described in *The Theory of the Photographic Process,* Fourth Edition, T. H. James, Macmillan Publishing Company, Inc., 1977 pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S.Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The sulfenimide compounds are also particularly useful with emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire P010 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements, or transmission or reflection elements(including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment.

The following examples illustrate the practice of this invention: They are not intended to be exhaustive of all possible variations of the invention.

EXAMPLES

Compound 1: N-(phenylthio)phthalimide (CAS Reg. No. 14204-27-4)

Compound 2: N-(4-chlorophenylthio)phthalimide (CAS Reg. No. 14204-31-0)

Compound 3: N-(4methylphenylsulfoxide)phthalimide (CAS Reg. No. 42300-58-3)

Compound 4: N-(4-methylphenylsulfone)phthalimide (CAS Reg. No. 27722-45-8)

Example 1

A sample of 1.51 μm×0.112 μm tabular AgBr emulsion precipitated according to Example 3 of U.S. Pat. No. 5,147,771 was chemically sensitized with optimum levels of conventional sulfur and gold sensitizers (Emulsion A). To induce additional speed another sample of emulsion was first treated with an amine borane compound and then given an identical sulfur and gold sensitization (Emulsion B). Compound 1 and Compound 2 were compared against a mercuric salt (Hg) (CAS Reg. No. 63325-16-6) by addition to the emulsion between the amine borane treatment and the subsequent sulfur and gold sensitization. The emulsions were then diluted with gelatin, water, and coating aids and cast onto a blue-tinted cellulose acetate support. The emulsion layers were then hardened with an overcoat containing gelatin, water, coating aids and a vinylsulfone hardener. The resulting dried coatings were exposed for 0.02 seconds with white light and developed in Kodak RP X-OMAT. Table 1 shows the minimum density (D-min) and Relative Speeds of the emulsion coatings.

TABLE 1

| Description | Additive | Level 10-6 mol/Ag mol) | Relative Speed | D-min |
|---|---|---|---|---|
| Emulsion A | none | | 100 | 0.06 |
| Emulsion B | none | | 174 | 0.70 |
| Comparison | Hg | 0.1 | 95 | 0.06 |
| Invention | Compound 1 | 0.1 | 246 | 0.70 |
| " | " | 1 | 257 | 0.49 |
| " | " | 10 | 234 | 0.31 |
| " | " | 100 | 107 | 0.06 |
| " | " | 1000 | 53 | 0.04 |
| Invention | Compound 2 | 0.1 | 257 | 0.69 |
| " | " | 1 | 257 | 0.38 |
| " | " | 10 | 132 | 0.09 |
| " | " | 100 | 98 | 0.05 |
| " | " | 1000 | 48 | 0.04 |

The results in Table 1 demonstrate that the addition of an inventive sulfenimide can reverse fog, induced by the use of an amine borane, to a position equivalent to that obtained by an environmentally undesirable mercuric salt. The proper amount of sulfenimide can be determined by one skilled in the art

Example 2

A sample of the emulsion described in Example 1 was chemically sensitized with conventional sulfur and gold sensitizers (Emulsion A-1). Another sample of emulsion was first treated with an amine borane compound and then given an identical sulfur and gold sensitization (Emulsion B-1). Compound 2, Compound 3, and Compound 4 were compared against a mercuric salt (Hg) (CAS Reg. No. 63325-16-6) by addition to the emulsion between the amine borane treatment and the subsequent sulfur and gold sensitization. The emulsions were then diluted with gelatin, water, and coating aids and cast onto a blue-tinted cellulose acetate support. The emulsion layers were then hardened with an overcoat containing gelatin, water, coating aids and a vinylsulfone hardener. The resulting dried coatings were exposed for 0.02 seconds with white light and developed in Kodak RP X-OMAT. Table 2 shows the minimum density (D-min) and Relative Speeds of the emulsion coatings.

TABLE 2

| Description | Additive | Level 10-6 mol/Ag mol) | Relative Speed | D-min |
|---|---|---|---|---|
| Emulsion A-1 | none | | 100 | 0.05 |
| Emulsion B-1 | none | | 302 | 0.31 |
| Comparison | Hg | 0.1 | 78 | 0.04 |
| Invention | Compound 2 | 1 | 302 | 0.23 |
| " | " | 10 | 219 | 0.12 |
| " | " | 100 | 105 | 0.05 |
| " | " | 1000 | 57 | 0.03 |
| Invention | Compound 3 | 1 | 309 | 0.31 |
| " | " | 10 | 309 | 0.33 |
| " | " | 100 | 219 | 0.13 |
| " | " | 1000 | 82 | 0.04 |
| Comparison | Compound 4 | 1 | 302 | 0.27 |
| " | " | 10 | 324 | 0.35 |
| " | " | 100 | 331 | 0.33 |
| " | " | 1000 | 309 | 0.27 |

The results in table 2 demonstrates that addition of an inventive sulfenimide can reverse fog, while maintaining a speed increase induced by the use of an amine borane, to a position equivalent to that obtained by an environmentally undesirable mercuric salt.

Example 3

Emulsion C

This emulsion demonstrates a conventional cubic emulsion precipitated in a synthetic peptizer. A pure chloride silver halide emulsion was precipitated by equimolar addition of silver nitrate and sodium chloride into a well-stirred reactor containing synthetic peptizer.

A reaction vessel contained 5.4 L of a solution that was 33.3% in synthetic peptizer. The contents of the reaction vessel were maintained at 25° C. and the pH was adjusted to 3.0. To this stirred solution at 25° C., 149 mL of a solution 0.5M in $AgNO_3$ and 133.5 mL of a solution 0.6M in NaCl were added simultaneously at 29.8 mL/min for 5 minutes. The 0.5M silver nitrate solution and the 0.6M sodium chloride solution were added simultaneously with a ramped linearly increasing flow from 29.8 mL/min to 90 mL/min over 14.2 minutes. Then the 2.8M silver nitrate solution and the 3.0M sodium chloride solution were added simultaneously with a ramped linearly increasing flow from 22.3 mL/min to 54 mL/min over 20 minutes. The 2.8M silver nitrate solution and 3.0M sodium chloride solution were then added simultaneously at 54 mL/min for 70 minutes. The resulting emulsion was a cubic grain silver chloride emulsion of 0.32 μm in edgelength size. The emulsion was then washed using an ultrafiltration unit, and final pH and pCl were adjusted to 5.6 and 1.7 respectively.

Emulsion D

Emulsion D was prepared the same as Emulsion C except that 100 mg of Compound 2/Ag mole was added to the reaction vessel.

Emulsion E

Emulsion E was prepared the same as Emulsion C except that 100 mg of Compound 1/Ag mole was added to the reaction vessel.

The emulsions were optimally sensitized by the customary techniques known in the art. Detailed procedures are described below for the emulsions of Examples 3, 3*a*, 3*b*, and 3*c*.

In magenta-sensitized emulsions the following magenta sensitizing dye was used:

Spectral Sensitizing Dye A

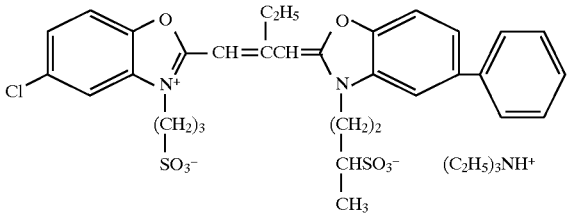

Just prior to coating on resin coated paper support magenta sensitized emulsions were mixed with magenta dye forming coupler dispersion containing Coupler A.

Coupler A

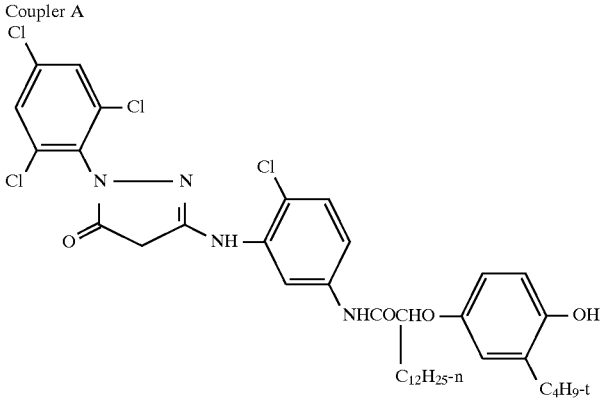

In cyan-sensitized emulsions the following cyan Spectral Sensitizing Dye B was used:

Spectral Sensitizing Dye B

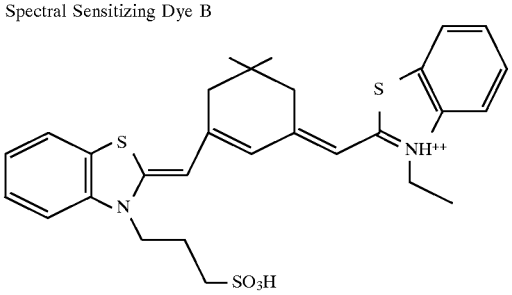

Just prior to coating on resin coated paper support cyan sensitized emulsions were mixed with cyan dye forming coupler dispersion containing Coupler B.

Coupler B

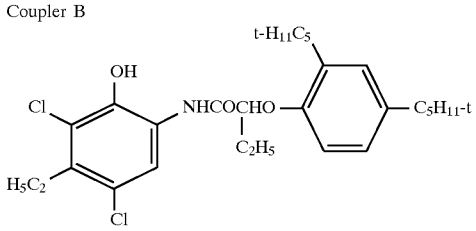

The magenta sensitized emulsions were coated at 26 mg silver per square foot while the cyan sensitized emulsions were coated at 17 mg silver per square foot on resin-coated paper support. The coatings were overcoated with gelatin layers and the entire coating was hardened with bis (vinylsulfonylmethyl)ether.

The coatings were exposed through a step wedge with 3000K tungsten source at an exposure time of 0.10 second. All coatings were processed in KODAK™ Ektacolor RA-4.

Example 3*a*

This example compares silver chloride cubic emulsions precipitated in synthetic peptizer and sensitized for the cyan color record. The sensitization details were as follows:

Part 1.1: A portion of silver chloride Emulsion C was optimally sensitized by the addition of the optimum amount of colloidal gold sulfide. The emulsion was heated up to 65° C. for 20 minutes, and then was cooled down to 40° C. and 1-(3-acetamidophenyl)-5-mercaptotetrazole was added followed by addition of soluble potassium bromide, followed by addition of Spectral Sensitizing Dye B.

Part 1.2: A portion of silver chloride Emulsion D was sensitized identically as in Part 1.1.

The sensitometric data are summarized in Table 3.

TABLE 3

(Cyan)

| Coating ID | mg Compound 2/ Ag mole | D-min | Speed | Lotoe | Toe | Shoulder | Contrast | D-max |
|---|---|---|---|---|---|---|---|---|
| Part 1.1 | 0 | 0.378 | 105 | 0.437 | 0.534 | 1.874 | 2.364 | 2.635 |
| Part 1.2 | 100 | 0.135 | 90 | 0.236 | 0.401 | 2.372 | 2.787 | 2.712 |

The results in Table 3 show that silver chloride cubic emulsions precipitated with Compound 2 of this invention have significantly reduced fresh fog. Gold-sulfide sensitized silver chloride cubic emulsions exhibit also some other beneficial effects of Compound 2 incorporation into the grain; the presence of Compound 2 significantly improves shoulder and contrast.

Example 3*b*

This example compares silver chloride cubic emulsions precipitated in synthetic peptizer with Compound 1 or Compound 2, and sensitized with sulfur and gold compounds for the magenta color record. The sensitization details were as follows:

Part 2.1: A portion of silver chloride Emulsion C was optimally sensitized by the addition of the optimum amount of green Spectral Sensitizing Dye A followed by addition of the optimum amount of sulfur and followed by the optimum amount of gold(I). The emulsion was heated up to 60° C. for 45 minutes. Then the emulsion was cooled down to 40° C. and 1-(3-acetamidophenyl)-5-mercaptotetrazole was added followed by addition of soluble potassium bromide.

Part 2.2: A portion of silver chloride Emulsion D was sensitized identically as in Part 2.1.

Part 2.3: A portion of silver chloride Emulsion E was sensitized identically as in Part 2.1.

The sensitometric data are summarized in Table 4.

TABLE 4

| ID | mg/Ag mole | Sulfenimide | D-min | Speed | Lotoe | Toe | Shoulder | Contrast | D-max |
|---|---|---|---|---|---|---|---|---|---|
| Part 2.1 | 0 | none | 0.166 | 178 | 0.271 | 0.446 | 1.794 | 2.145 | 2.359 |
| Part 2.2 | 100 | Compound 2 | 0.127 | 125 | 0.375 | 0.556 | 1.696 | 1.648 | 2.383 |
| Part 2.3 | 100 | Compound 1 | 0.124 | 149 | 0.214 | 0.392 | 1.934 | 2.441 | 2.449 |

The results in Table 4 show that silver chloride cubic emulsions precipitated with Compound 1 or with Compound 2 of this invention have significantly reduced fresh fog. Gold(I) sensitized silver chloride cubic emulsions exhibit also some other beneficial effects of Compound 1 incorporation into the grain; the presence of Compound 1 significantly improves D-max, shoulder and contrast Example 3*c*

This example compares silver chloride cubic emulsions precipitated in synthetic peptizer with Compound 1 or with Compound 2, and sensitized with colloidal gold-sulfide compound for magenta color record. The sensitization details were as follows:

Part 3.1: A portion of silver chloride Emulsion C was optimally sensitized by the addition of the optimum amount of green Spectral Sensitizing Dye A followed by addition of the optimum amount of colloidal gold-sulfide. The emulsion was heated up to 60° C. for 45 minutes. Then the emulsion was cooled down to 40° C. and 1-(3-acetamidophenyl)-5-mercaptotetrazole was added followed by addition of soluble potassium bromide.

Part 3.2: A portion of silver chloride Emulsion D was sensitized identically as in Part 3.1.

Part 3.3: A portion of silver chloride Emulsion E was sensitized identically as in Part 3.1.

Sensitometric data are summarized in Table 5.

TABLE 5

| ID | mg/Ag mole | Sulfenimide | D-min | Speed | Lotoe | Toe | Shoulder | Contrast | D-max |
|---|---|---|---|---|---|---|---|---|---|
| Part 3.1 | 0 | none | 0.158 | 182 | 0.292 | 0.446 | 1.774 | 2.441 | 2.386 |
| Part 3.2 | 100 | Compound 2 | 0.135 | 168 | 0.287 | 0.556 | 1.732 | 2.002 | 2.461 |
| Part 3.3 | 100 | Compound 1 | 0.143 | 180 | 0.286 | 0.392 | 1.760 | 1.934 | 2.492 |

The results in Table 5 show that silver chloride cubic emulsions precipitated with Compound 1 or with Compound 2 of this invention have significantly reduced fresh fog when sensitized with colloidal gold-sulfide for the magenta record.

The invention has been described in detail with particular reference to the preferred embodiments thereof, but it will be understood that variations and modifications can be effected within the scope of the invention.

What is claimed is:

1. A silver halide photographic element comprising a silver halide emulsion precipitated or chemically sensitized or both in the presence of a sulfenimide compound represented by the formula:

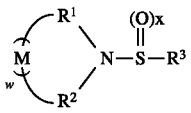

wherein M represents the atoms necessary to form, with $R^1$ and $R^2$, a five or six-membered ring or a multiple ring system; $R^1$ and $R^2$ are independently carbonyl or sulfonyl groups; $R^3$ is independently a substituted or unsubstituted aromatic or heterocyclic group and x is 0 or 1.

2. The photographic element of claim 1 wherein $R^3$ is independently a substituted or unsubstituted aryl group having 6 to 10 carbon atoms or a substituted or unsubstituted 5 to 6-membered heterocyclic ring.

3. The photographic element of claim 1 wherein M represents the atoms necessary to form, with $R^1$ and $R^2$, a substituted or unsubstituted aryl group having 6 to 10 carbon atoms or a substituted or unsubstituted 5 to 10-membered heterocyclic ring.

4. The photographic element of claim 3 wherein $R^1$ and $R^2$ are carbonyl groups.

5. The photographic element of claim 4 wherein M represents the atoms necessary to form, with $R^1$ and $R^2$, a phthalimide or succinimide group.

6. The photographic element of claim 3 wherein $R^3$ is independently a substituted or unsubstituted aryl group having 6 to 10 carbon atoms or a substituted or unsubstituted 5 to 6-membered heterocyclic ring.

7. The photographic element of claim 1 wherein the concentration of the sulfenimide compound is from $1\times10^{-9}$ to $1\times10^{-2}$ mol/mol Ag.

8. The photographic element of claim 7 wherein the silver halide emulsion is chemically sensitized in the presence of the sulfenimide compound and the concentration of the sulfenimide compound is from $1\times10^{-6}$ to $1\times10^{-2}$ mol/mol Ag.

9. The photographic element of claim 1 wherein the silver halide emulsion is precipitated in the presence of the sulfenimide compound.

10. The photographic element of claim 9 wherein the concentration of the sulfenimide compound is from $1\times10^{-9}$ to $1\times10^{-3}$ mol/mol Ag.

11. A method of making a silver halide emulsion comprising precipitating and chemically sensitizing the emulsion and further comprising adding to the emulsion at any time before or during chemical sensitization a sulfenimide compound represented by the formula:

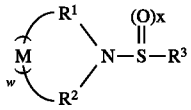

wherein M represents the atoms necessary to form, with $R^1$ and $R^2$, a five or six-membered ring or a multiple ring system; $R^1$ and $R^2$ are independently carbonyl or sulfonyl groups; $R^3$ is independently a substituted or unsubstituted aromatic or heterocyclic group and x is 0 or 1.

12. The method of claim 11 wherein $R^3$ is independently carbon atoms, a substituted or unsubstituted aryl group having 6 to 10 carbon atoms or a substituted or unsubstituted 5 to 6-membered heterocyclic ring.

13. The method of claim 11 wherein M represents the atoms necessary to form, with $R^1$ and $R^2$, a substituted or unsubstituted aryl group having 6 to 10 carbon atoms or a substituted or unsubstituted 5 to 10-membered heterocyclic ring.

14. The method of claim 13 wherein $R^1$ and $R^2$ are carbonyl groups.

15. The method of claim 14 wherein M represents the atoms necessary to form, with $R^1$ and $R^2$, a phthalimide or succinimide group.

16. The method of claim 11 wherein the concentration of the sulfenimide compound added is from $1\times10^{-9}$ to $1\times10^{-2}$ mol/mol Ag.

17. The method of claim 11 wherein the silver halide emulsion is chemically sensitized in the presence of the sulfenimide compound and the concentration of the sulfenimide compound added is from $1\times10^{-6}$ to $1\times10^{-2}$ mol/mol Ag.

18. The method of claim 11 wherein the silver halide emulsion is precipitated in the presence of the sulfenimide compound.

19. The method of claim 18 wherein the concentration of the sulfenimide compound is from $1\times10^{-9}$ to $1\times10^{-3}$ mol/mol Ag.

* * * * *